US008651445B2

(12) United States Patent
Lee

(10) Patent No.: US 8,651,445 B2
(45) Date of Patent: Feb. 18, 2014

(54) PORTABLE BOOK HOLDER

(71) Applicant: Sang-Hwa Lee, Gimhae-si (KR)

(72) Inventor: Sang-Hwa Lee, Gimhae-si (KR)

( * ) Notice: Subject to any disclaimer, the term of this patent is extended or adjusted under 35 U.S.C. 154(b) by 0 days.

(21) Appl. No.: 13/956,525

(22) Filed: Aug. 1, 2013

(65) Prior Publication Data

US 2013/0313393 A1 Nov. 28, 2013

Related U.S. Application Data

(63) Continuation of application No. PCT/KR2012/001635, filed on Mar. 6, 2012.

(30) Foreign Application Priority Data

Mar. 28, 2011 (KR) ..... 10-2011-0027320

(51) Int. Cl.
*A47B 23/00* (2006.01)

(52) U.S. Cl.
USPC ..... 248/454; 248/455; 248/447

(58) Field of Classification Search
USPC ..... 248/455, 446, 447, 454, 460, 461, 462, 248/463, 371, 398
See application file for complete search history.

(56) References Cited

U.S. PATENT DOCUMENTS

| | | | | | |
|---|---|---|---|---|---|
| 1,916,576 | A | * | 7/1933 | Landsittel | 248/447 |
| 1,990,103 | A | * | 2/1935 | Van Alstyne | 248/447 |
| 2,908,465 | A | * | 10/1959 | Lykes | 248/445 |
| 3,029,548 | A | * | 4/1962 | Braha | 248/455 |
| 3,408,032 | A | * | 10/1968 | Francis | 248/450 |

FOREIGN PATENT DOCUMENTS

| | | | |
|---|---|---|---|
| JP | 64-4124 | U | 1/1989 |
| KR | 20-1995-0002827 | U | 2/1995 |
| KR | 20-0220683 | U | 4/2001 |
| KR | 1020030012977 | A | 2/2003 |
| KR | 1020040052585 | A | 6/2004 |
| KR | 20-0408294 | U | 2/2006 |
| KR | 1020060108483 | A | 10/2006 |
| KR | 20-0436409 | U | 8/2007 |
| KR | 100805554 | B1 | 2/2008 |

OTHER PUBLICATIONS

International Search Report, PCT/KR2012/001635, WIPO, Oct. 8, 2012.

* cited by examiner

*Primary Examiner* — Anita M King
(74) *Attorney, Agent, or Firm* — Park & Associates IP Law, P.C.

(57) ABSTRACT

The present invention relates to a portable book holder that can be converted from its original size into a small size if a user wants to carry the portable book holder, thereby making it easy to be carried, adjust a supporting area in accordance with the sizes of a book, and allow a user to adjust a book holding stand to his or her desired arbitrary angle.

8 Claims, 5 Drawing Sheets

PORTABLE BOOK HOLDER

REFERENCE TO RELATED APPLICATIONS

This is a continuation of pending International Patent Application PCT/KR2012/001635 filed on Mar. 6, 2012, which designates the United States and claims priority of Korean Patent Application No. 10-2011-0027320 filed on Mar. 28, 2011, the entire contents of which are incorporated herein by reference.

FIELD OF THE INVENTION

The present invention relates to a portable book holder that can be converted from its original size into a small size if a user wants to carry the portable book holder, thereby making it easy to be carried, adjust a supporting area in accordance with the sizes of a book, and allow a user to adjust a book holding stand to his or her desired arbitrary angle.

BACKGROUND OF THE INVENTION

Generally, a book holder is designed to maintain a book to the same height as a user's eyes, while having an appropriate distance from the book, and thus, the book holder has a plurality of locking protrusions formed on the bottom surface thereof so as to adjust the inclination of the book.

FIG. 1 is a perspective view showing a conventional book holder. The conventional book holder includes a book holding stand 10 for supporting the underside surface of a book, a locking member 20 mounted on the rear side of the book holding stand 10, and a supporting stand 30 having locking protrusions 35 onto which the locking member 20 is fixedly locked formed thereon so as to adjust the angle of the book holding stand 10.

Under the above-mentioned configuration, however, the conventional book holder is inconvenient to be carried due its fixed size, and accordingly, if a large or small-sized book is located on the book holding stand, it may be not supported thereon well. Especially, the book holding stand is adjusted only to the fixed angles, thereby making it impossible to conduct the angle adjustment thereof to a user's desired arbitrary angle.

SUMMARY OF THE INVENTION

Accordingly, the present invention has been made in view of the above-mentioned problems occurring in the prior art, and it is an object of the present invention to provide a portable book holder that can be converted from its original size into a small size if a user wants to carry the portable book holder, thereby making it easy to be carried, adjust a supporting area in accordance with the sizes of a book, and allow a user to adjust a book holding stand to his or her desired arbitrary angle.

To accomplish the above object, according to the present invention, there is provided a portable book holder including: a body having long grooves formed along the left and light sides thereof; a screw shaft rotatably mounted inside the body and having a right-handed screw and a left-handed screw formed symmetrically on the front and rear outer peripheries thereof; a front nut and a rear nut coupled correspondingly to the front side right-handed screw and the rear side left-handed screw and moved in the forward and backward directions of the screw shaft in such a manner as to be distant from or adjacent to each other in accordance with the rotation of the screw shaft; a book holding stand hinge-coupled to the front nut on the front end thereof and having a plurality of left and right supporting members extended and contracted in a telescoping manner in the left and right directions from the inside thereof so as to support the underside surface of the book and a folding type bottom supporting member disposed on the top surface of the front end thereof so as to support the bottom end of the book; an angle adjusting member hinge-coupled to the rear nut on one end thereof and rotatably coupled to the underside surface of the book holding stand on the other end thereof so as to adjust the angle of the book holding stand through the forward and backward movements of the front nut and the rear nut in accordance with the rotation of the screw shaft; and a cover having long coupling protrusions formed along the inner surfaces of the left and right sides thereof in such a manner as to be slidingly inserted into the long grooves of the body and coupled to the body to cover the top surface of the book holding stand.

According to the present invention, preferably, each of the front nut and the rear nut has a guide wheel contacted rotatably with the downwardly-recessed upper surface of the body upon the movement in the forward and backward directions of the screw shaft.

According to the present invention, preferably, the portable book holder further includes an auxiliary book holding stand coupled to the rear end portion of the book holding stand in such a manner as to be slidingly moved forwardly and backwardly.

According to the present invention, preferably, the auxiliary book holding stand has an auxiliary left and right supporting member extended and contracted in a telescoping manner in the left and right directions from the inside thereof so as to support the underside surface of the book.

According to the present invention, preferably, the portable book holder further includes: a pair of auxiliary left and right side bottom supporting members rotatably coupled to the left and right sides of the bottom supporting member on one end thereof and turned on the other end thereof in such a manner as to be extended in left and right directions of the bottom supporting member; and a pair of left and right fixing protrusions formed on the top surfaces of the other end of the pair of auxiliary left and right side bottom supporting members so as to fix both side bottom ends of the open book, so that the open state of the book supported by means of the book holding stand is maintained.

According to the present invention, preferably, the portable book holder further includes a handle coupled to the front end of the screw shaft by means of a bevel gear.

According to the present invention, preferably, the portable book holder further includes a plurality of fixing legs rotatably coupled to the left and right sides of the underside surface of the body on one end thereof and turned on the other end thereof in such a manner as to be exposed from the body.

According to the present invention, preferably, the portable book holder further includes a pencil case in which writing instruments are accommodated coupled to the top surface of the cover.

According to the present invention, the portable book holder can be converted from its original size into a small size if a user wants to carry the portable book holder, thereby making it easy to be carried, adjust a supporting area in accordance with the sizes of a book, and allow a user to adjust the book holding stand to his or her desired arbitrary angle through the formation of the telescoping left and right supporting members, the folding type bottom supporting member, and the cover.

Moreover, the portable book holder can substantially extend the supporting area through the auxiliary book holding stand, the left and right supporting members and the auxiliary bottom supporting members, thereby easily supporting even a large-sized book, and also can maintain the open state of the book by means of the fixing protrusions formed on the auxiliary bottom supporting members.

Further, the portable book holder can allow the book holding stand to be easily and conveniently adjusted to a user's desired arbitrary angle through the front nut and the rear nut coupled correspondingly to the screw shaft on which the front side right-handed screw and the rear side left-handed screw are formed.

Additionally, the portable book holder further has the pencil case in which writing instruments are accommodated coupled to the top surface of the cover, so that while being used as the pencil case, it can be separated from the pencil case if the user wants to read a book and used as the book holder, thereby providing high portability and many conveniences in use.

DETAILED DESCRIPTION OF THE INVENTION

Figure 1:
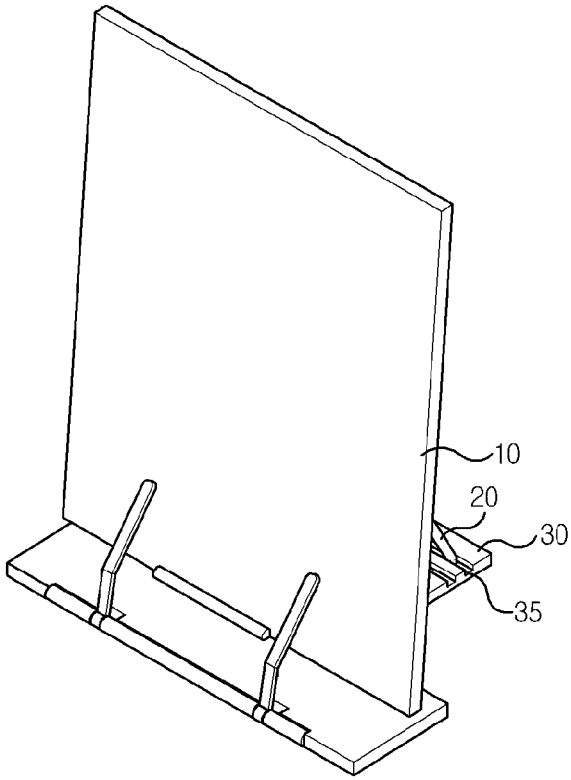
FIG. 1 (PRIOR ART)
FIG. 1 is a perspective view showing a conventional book holder.

According to the present invention, a portable book holder includes: a body having long grooves formed along the left and light sides thereof; a screw shaft rotatably mounted inside the body and having a right-handed screw and a left-handed screw formed symmetrically on the front and rear outer peripheries thereof; a front nut and a rear nut coupled correspondingly to the front side right-handed screw and the rear side left-handed screw and moved in the forward and backward directions of the screw shaft in such a manner as to be distant from or adjacent to each other in accordance with the rotation of the screw shaft; a book holding stand hinge-coupled to the front nut on the front end thereof and having a plurality of left and right supporting members extended and contracted in a telescoping manner in the left and right directions from the inside thereof so as to support the underside of the book and a folding type bottom supporting member disposed on the top surface of the front end thereof so as to support the bottom end of the book; an angle adjusting member hinge-coupled to the rear nut on one end thereof and rotatably coupled to the underside surface of the book holding stand on the other end thereof so as to adjust the angle of the book holding stand through the forward and backward movements of the front nut and the rear nut in accordance with the rotation of the screw shaft; and a cover having long coupling protrusions formed along the inner surfaces of the left and right sides thereof in such a manner as to be slidingly inserted into the long grooves of the body and coupled to the body to cover the top surface of the book holding stand.

As shown in FIGS. 2 to 10, a portable book holder according to the present invention includes a body 100, a screw shaft 200, a front nut 310, a rear nut 320, a book holding stand 400, an angle adjusting member 500 and a cover 600 and further includes an auxiliary book holding stand 700, a handle 920, fixing legs 930 and a pencil case 940.

Figure 2:
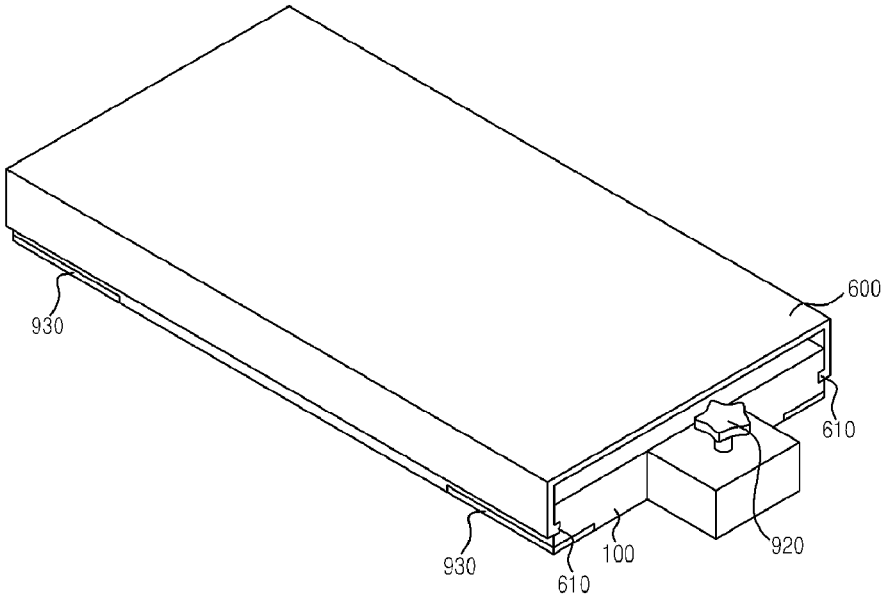
FIG. 2 is a perspective view showing a portable book holder according to one embodiment of the present invention.
Figure 3:
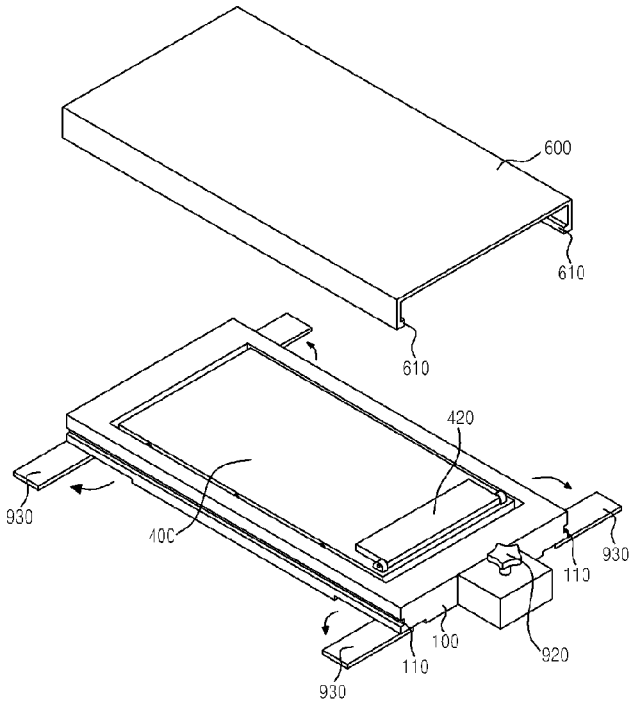
FIG. 3 is a perspective view showing the state where a cover is separated from the portable book holder of FIG. 2.

As shown in FIGS. 2 to 10, the body 100 takes a shape of a rectangular cuboid to which a variety of parts as will be discussed later are coupled and attached, and accordingly, the body 100 should be firmly made. Further, since the underside of the body 100 is fixedly contacted with a desk or table, the body 100 should have good flatness. As shown in FIGS. 2 and 3, the body 100 has long grooves 110 formed along the left and right sides thereof in such a manner as to insert the cover 600 as will be discussed later thereinto. When the book holding stand 400 as will be discussed later is adjusted in angle, while supporting the underside surface of a book through the mutual action among the screw shaft 200, the front nut 310, the rear nut 320 and the angle adjusting member 500, the body 100 becomes a reference surface with respect to the angle variation of the book holding stand 400.

Figure 4:
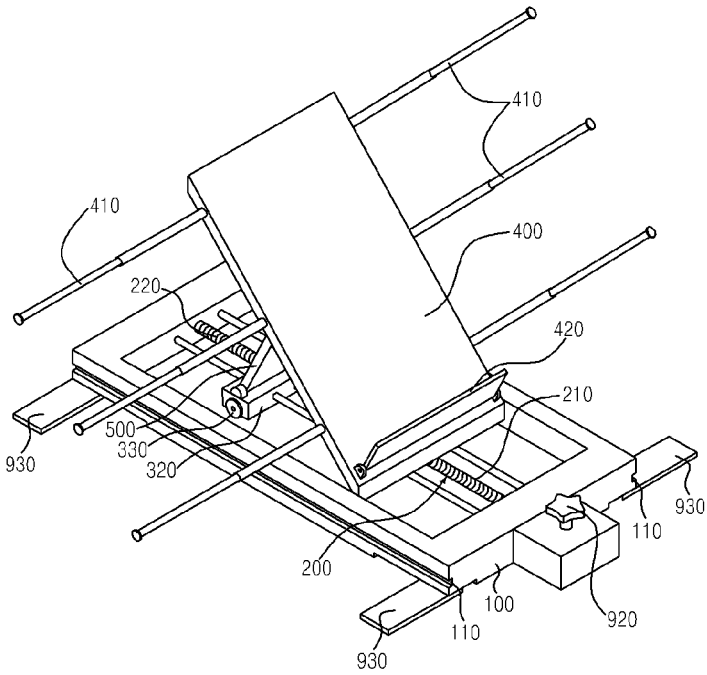
FIG. 4 is a perspective view showing the use state of the portable book holder of FIG. 2.
Figure 5:
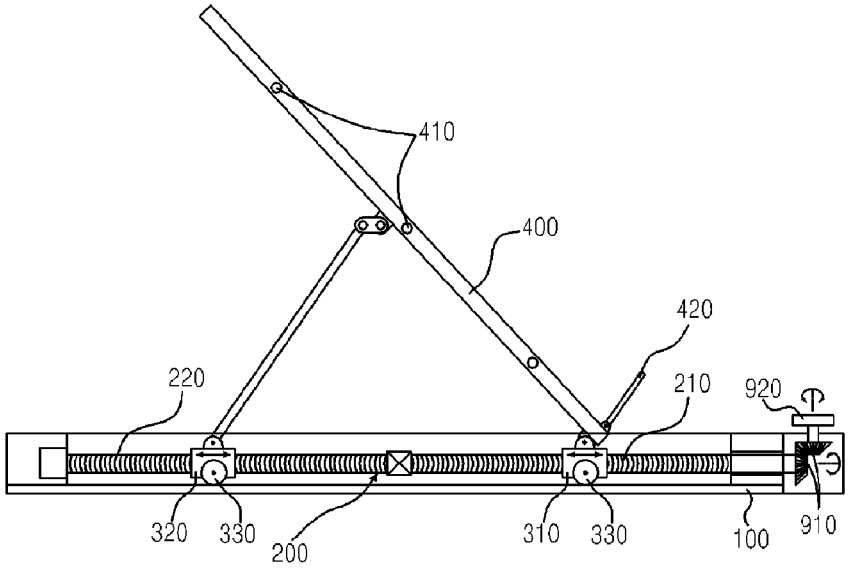
FIG. 5 is a side sectional view of FIG. 4.

As shown in FIGS. 4 and 5, the screw shaft 200 is rotatably mounted inside the body 100 and has a right-handed screw 210 and a left-handed screw 220 formed symmetrically on the front and rear outer peripheries thereof. Also, the front nut 310 and the rear nut 320 are coupled correspondingly to the front side right-handed screw 210 and the rear side left-handed screw 220 and moved in the forward and backward directions of the screw shaft 200 in such a manner as to be distant from or adjacent to each other in accordance with the rotation of the screw shaft 200. That is, the screw shaft 200 is longitudinally mounted forwardly and backwardly inside the body 100 in such a manner as to be rotatable on both ends thereof and has the front side right-handed screw 210 and the rear side left-handed screw 220 formed symmetrically on the front and rear sides thereof. Accordingly, the front nut 310 coupled to the front side of the screw shaft 200 and the rear nut 320 coupled to the rear side of the screw shaft 200 are moved in the forward and backward directions of the screw shaft 200 in such a manner as to be distant from or adjacent to each other in accordance with the rotation of the screw shaft 200. The front nut 310 and the rear nut 320 are coupled to the book holding stand 400 and the angle adjusting member 500 as will be discussed later, so that the angle of the book holding stand 400 is adjusted in accordance with the rotation of the screw shaft 200. On the other hand, the front end of the screw shaft 200 is protruded from the front side of the body 100 so as to rotate the screw shaft 200, and thus, the front end of the screw shaft 200 is taken directly by a user to rotate the screw shaft 200.

Further, as shown in FIGS. 2 to 5, the handle 920 is coupled to the front end of the screw shaft 200 by means of a bevel gear 910. That is, if a rotary force is transmitted to the bevel gear 910 by easily turning the handle 920 through the user's manipulation, the screw shaft 200 can be readily rotated through the engagement of the front end of the screw shaft 200 with the bevel gear 910.

As shown in FIGS. 3 to 5, the book holding stand 400 is hinge-coupled to the front nut 310 on the front end thereof and has a plurality of left and right supporting members 410 extended and contracted in a telescoping manner in the left and right directions from the inside thereof so as to support the underside of the book and a folding type bottom supporting member 420 disposed on the top surface of the front end thereof so as to support the bottom end of the book. Further, the angle adjusting member 500 is hinge-coupled to the rear nut 320 on one end thereof and rotatably coupled to the underside surface of the book holding stand 400 on the other end thereof, thereby adjusting the angle of the book holding stand 400 through the forward and backward movements of the front nut 310 and the rear nut 320 in accordance with the rotation of the screw shaft 200. For example, if the screw shaft 200 is forwardly rotated to allow the front nut 310 and the rear nut 320 to be distant from each other, the front end of the book holding stand 400 and one end of the angle adjusting member 500 are distant from each other, and as shown in FIG. 3, the angle of the book holding stand 400 becomes small. At this time, when the front nut 310 and the rear nut 320 are spaced apart from each other by a maximum distance, the book holding stand 400 and the angle adjusting member 500 are laid on top of each other in parallel with each other. Contrarily, if the screw shaft 200 is reversely rotated to allow the front nut 310 and the rear nut 320 to be adjacent to each other, the front end of the book holding stand 400 and one end of the angle adjusting member 500 are adjacent to each other, and as shown in FIGS. 4 and 5, the angle of the book holding stand 400 becomes large. At this time, when the front nut 310 and the rear nut 320 are adjacent to each other by a maximum distance, the book holding stand 400 and the angle adjusting member 500 are maintained to the largest angle.

As shown in FIGS. 3 to 5, the book holding stand 400 has the plurality of left and right supporting members 410 extended and contracted in a telescoping manner in the left and right directions from the inside thereof so as to support the underside of the book and the folding type bottom supporting member 420 disposed on the top surface of the front end thereof so as to support the bottom end of the book. The book holding stand 400 takes a shape of a rectangular cuboid having a size smaller than the body 100 and supports the underside surface of the book. The left and right supporting members 410 of the book holding stand 400 are mounted at the interior of the book holding stand 400 in such a manner as to be extended and contracted in a telescoping manner like an antenna in the left and right directions to totally support the left and right parts of the underside surface of the book. When at least three or more left and right supporting members 410 are provided, they can support the underside surface of even a large-sized book. The folding type bottom supporting member 420 is disposed on the top surface of the front end of the book holding stand 400 and supports the bottom end of the book so as to prevent the book from being falling down. At this time, the folding type bottom supporting member 420 is foldably disposed on the top surface of the front end of the book holding stand 400 and further folded to give no interference to the cover 600. The bottom supporting member 420 is folded to an angle of 90 degrees upon the folding operation so as to more rigidly support the bottom end of the book. That is, the bottom supporting member 420 is made of a folding type hinge rotatable to 90 degrees.

Figure 10:
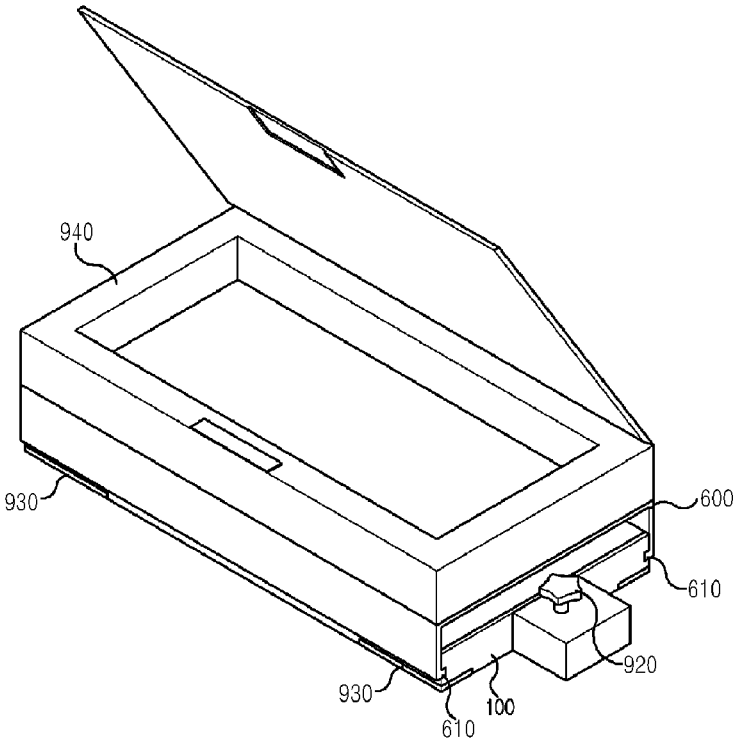
FIG. 10 is a perspective view showing a portable book holder according to another alternative embodiment of the present invention.

As shown in FIGS. 2 and 3, the cover 600 has long coupling protrusions 610 formed along the inner surfaces of the left and right sides thereof in such a manner as to be slidingly inserted into the long grooves 110 of the body 100 and coupled to the body 100 to cover the top surface of the book holding stand 400. That is, the cover 600 is covered in the state where the body 100 and the book holding stand 400 are folded and reduced to a small size, which makes it easy to be carried. On the other hand, as shown in FIG. 10, a pencil case 940 in which writing instruments are accommodated is coupled to the top surface of the cover 600, thereby serving as a given case as well as a writing instrument keeping space. As shown in FIG. 10, the pencil case 940 may be a rectangular shape made of the same material as the cover 600, but it may have a shape of a pouch.

As shown in FIG. 4, the fixing legs 930 are rotatably coupled to the left and right sides of the underside surface of the body 100 on the respective one ends thereof and turned on the other ends thereof in such a manner as to be exposed from the body 100. In the state where only the underside surface of the body 100 is tightly contacted fixedly with a desk, if a book is located on the book holding stand 400, the book holding stand 400 may be moved due to the weight of the book located thereon. Accordingly, the fixing legs 930 are exposed to the left and right sides of the body 100 to support the body 100 over a relatively large area, thereby achieving more rigid fixation.

On the other hand, the front nut 310 and the rear nut 320 are moved in the forward and backward directions of the screw shaft 200 in such a manner as to be adjacent to each other or distant from each other in accordance with the rotation of the screw shaft 200, and if the book is located on the book holding stand 400, the screw shaft 200 may be bent or deformed due to the weight of the book itself. At this time, when the front nut 310 and the rear nut 320 are moved in the forward and backward directions of the screw shaft 200 bent or deformed, the respective screw threads of the right-handed screw 210 and the left-handed screw 220 do not form regular distances, thereby failing to conduct the smooth movements of the front nut 310 and the rear nut 320. So as to avoid these problems, as shown in FIGS. 4 and 5, each of the front nut 310 and the rear nut 320 has a guide wheel 330 contacted rotatably with the downwardly-recessed upper surface of the body 100 upon the movement in the forward and backward directions of the screw shaft 200. That is, the guide wheels 330 of the front nut 310 and the rear nut 320 are contacted with the downwardly-recessed upper surface of the body 100, so that the repulsive force to the weight of the book itself is transmitted to the screw shaft 200 through the guide wheels 330, thereby preventing the screw shaft 200 from being bent or deformed. Furthermore, the guide wheels 330 serve to gently conduct the rolling operation upon the forward and backward movements of the front nut 310 and the rear nut 320. Accordingly, even though the book is located on the book holding stand 400, the forward and backward movements of the front nut 310 and the rear nut 320 are conducted more gently manner through the guide wheels 330.

Figure 6:
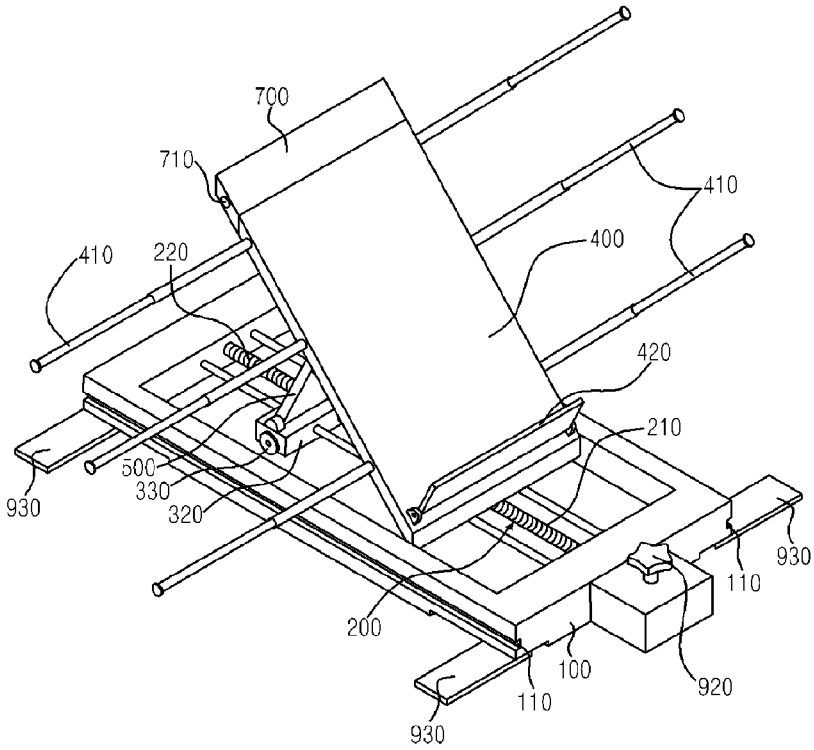
FIGS. 6 and 7 are perspective views showing a portable book holder according to an alternative embodiment of the present invention.
Figure 7:
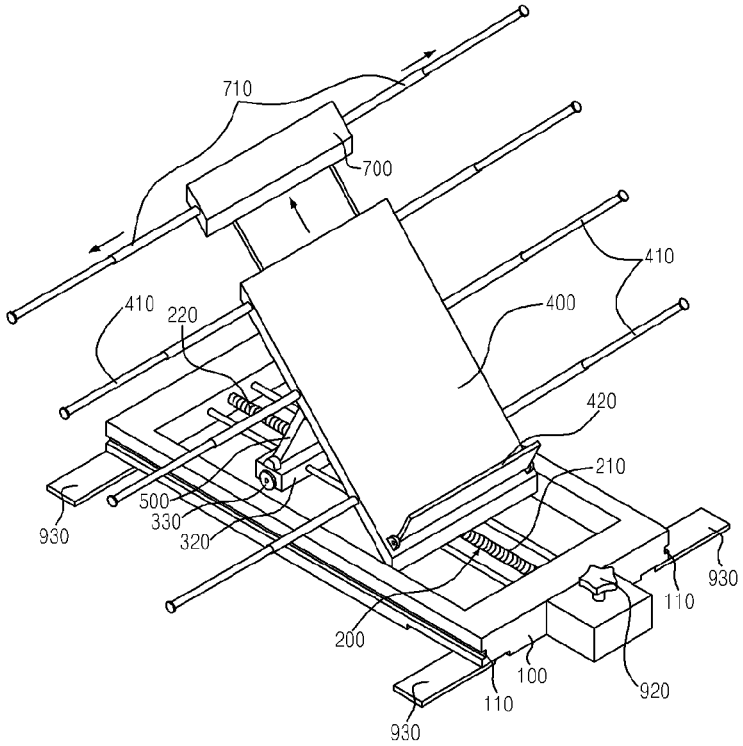

On the other hand, the underside surface of the book can be supported over a relatively large area on left and right sides thereof by means of the telescoping left and right supporting members 410, while being supported through the book holding stand 400. However, the left and right sides of the book are supported by means of the left and right supporting members 410, but if the height of the book is increased, the book is not supported well through the left and right supporting members 410. So as to solve these problems, as shown in FIGS. 6 and 7, the auxiliary book holding stand 700 is coupled to the rear end portion of the book holding stand 400 in such a manner as to be slidingly moved forwardly and backwardly. The auxiliary book holding stand 700 is coupled to the rear end portion of the book holding stand 400 and slidingly moved in the forward and backward directions of the book holding stand 400 to support the underside surface of the book over a relatively large area together with the book holding stand 400. At this time, the auxiliary book holding stand 700 is slidingly moved forwardly and backwardly through a guide member inserted into the book holding stand 400. In the same manner as the book holding stand 400, at this time, the auxiliary book holding stand 700 may have an auxiliary left and right supporting member 710 extended and contracted in a telescoping manner in the left and right directions from the inside thereof so as to support the underside surface of the book.

Figure 8:
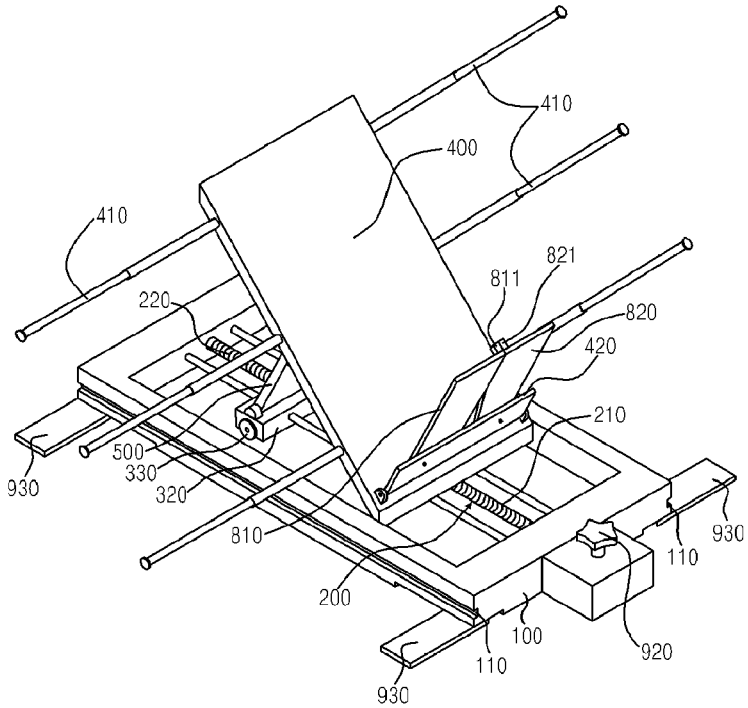
FIGS. 8 and 9 are perspective views showing a portable book holder according to another alternative embodiment of the present invention.
Figure 9:
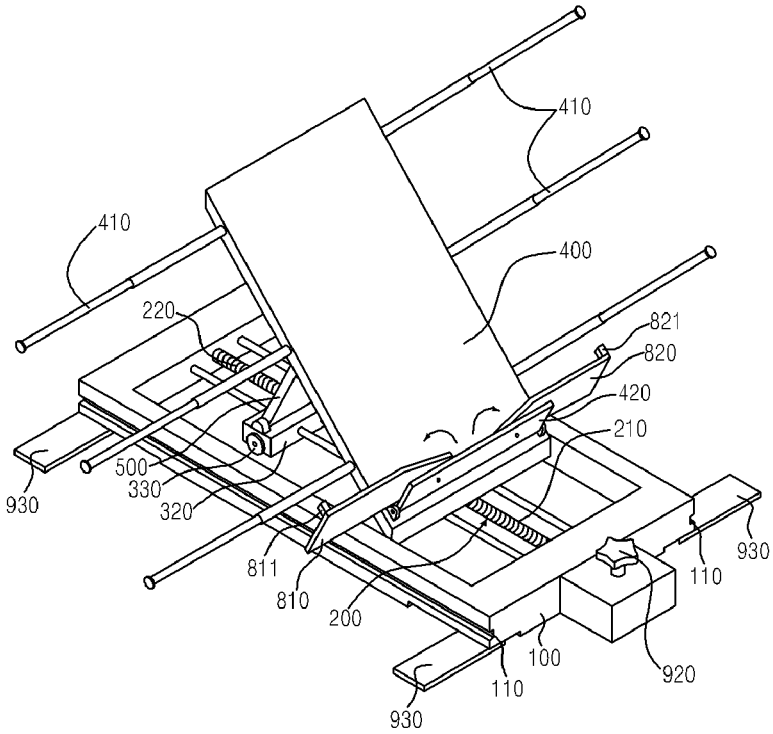

However, if the size of the book is increased, it is difficult to rigidly support the bottom end of the book only with the bottom supporting member 420, and thus, in the same manner as the auxiliary book holding stand 700 and the auxiliary left and right supporting member 710, as shown in FIGS. 8 and 9, a pair of auxiliary left side bottom supporting member 810 and auxiliary right side bottom supporting member 820 is rotatably coupled to the left and right sides of the bottom supporting member 420 on one end thereof and turned on the other end thereof in such a manner as to be extended in left and right directions of the bottom supporting member 420. Accordingly, even though the large-sized book is located on the book holding stand 400, the bottom end of the book can be more rigidly fixed over the relatively large area by means of the bottom supporting member 420 and the auxiliary left and right side bottom supporting members 810 and 820. At this time, in case where the bottom end of the book is supported by means of the auxiliary left and right side bottom supporting members 810 and 820, the open state of the book can be maintained even though the book is not pressed on the open state by means of a user's hand, thereby making it convenient to use. That is, as shown in FIGS. 8 and 9, the auxiliary left and right side bottom supporting members 810 and 820 further have a pair of left side fixing protrusion 811 and right side fixing protrusion 821 formed on the top surfaces of the other surfaces thereof so as to fix both side bottom ends of the open book, thereby allowing the open state of the book supported by means of the book holding stand 400 to be maintained. If the book is supported by means of the auxiliary left and right side bottom supporting members 810 and 820 in the open state, the pair of left side fixing protrusion 811 and right side fixing protrusion 821 is brought into contact with the bottom ends of both sides of the open book, thereby preventing the book being in the open state from being closed to allow the book to be maintained in the open state.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The portable book holder according to the present invention is applicable to the industrial field where a portable book holder is manufactured, whereby the portable book holder can be easily carried and the book holding stand can be adjusted to the user's desired arbitrary angle.

What is claimed is:

1. A portable book holder comprising:

a body having long grooves formed along the left and light sides thereof;

a screw shaft rotatably mounted inside the body and having a right-handed screw and a left-handed screw formed symmetrically on front and rear outer peripheries thereof;

a front nut and a rear nut coupled correspondingly to the front side right-handed screw and the rear side left-handed screw and moved in forward and backward directions of the screw shaft in such a manner as to be distant from or adjacent to each other in accordance with the rotation of the screw shaft;

a book holding stand hinge-coupled to the front nut on a front end thereof and having a plurality of left and right supporting members extended and contracted in a telescoping manner in the left and right directions from the inside thereof so as to support an underside of the book and a folding type bottom supporting member disposed on a top surface of the front end thereof so as to support a bottom end of the book;

an angle adjusting member hinge-coupled to the rear nut on one end thereof and rotatably coupled to an underside surface of the book holding stand on the other end thereof so as to adjust an angle of the book holding stand through the forward and backward movements of the front nut and the rear nut in accordance with the rotation of the screw shaft; and a cover having long coupling protrusions formed along inner surfaces of left and right sides thereof in such a manner as to be slidingly inserted into the long grooves of the body and coupled to the body to cover the top surface of the book holding stand.

2. The portable book holder according to claim 1, wherein each of the front nut and the rear nut has a guide wheel contacted rotatably with a downwardly-recessed upper surface of the body upon the movement in the forward and backward directions of the screw shaft.

3. The portable book holder according to claim 1, further comprising an auxiliary book holding stand coupled to the rear end portion of a book holding stand in such a manner as to be slidingly moved forwardly and backwardly.

4. The portable book holder according to claim 3, wherein the auxiliary book holding stand has an auxiliary left and right supporting member extended and contracted in a telescoping manner in the left and right directions from the inside thereof so as to support the underside surface of the book.

5. The portable book holder according to claim 1, further comprising:

a pair of auxiliary left and right side bottom supporting members rotatably coupled to the left and right sides of the bottom supporting member on one end thereof and turned on the other end thereof in such a manner as to be extended in left and right directions of the bottom supporting member; and a pair of left and right fixing protrusions formed on the top surfaces of the other end of the pair of auxiliary left and right side bottom supporting members so as to fix both side bottom ends of the open book, so that the open state of the book supported by the book holding stand is maintained.

6. The portable book holder according to claim 1, further comprising a handle coupled to the front end of the screw shaft by a bevel gear.

7. The portable book holder according to claim 1, further comprising a plurality of fixing legs rotatably coupled to the left and right sides of the underside surface of the body on one end thereof and turned on the other end thereof in such a manner as to be exposed from the body.

8. The portable book holder according to claim 1, further comprising a pencil case in which writing instruments are accommodated coupled to the top surface of the cover.

* * * * *